US007552989B2

(12) United States Patent
Katada

(10) Patent No.: US 7,552,989 B2
(45) Date of Patent: Jun. 30, 2009

(54) INK RUN-OUT DETECTOR, INK CARTRIDGE AND INK JET RECORDING APPARATUS

(75) Inventor: Masahito Katada, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 147 days.

(21) Appl. No.: 11/489,553

(22) Filed: Jul. 20, 2006

(65) Prior Publication Data

US 2007/0019010 A1 Jan. 25, 2007

(30) Foreign Application Priority Data

Jul. 22, 2005 (JP) ..... 2005-213296

(51) Int. Cl.
*B41J 29/393* (2006.01)

(52) U.S. Cl. ..... 347/19

(58) Field of Classification Search ..... 347/7, 347/19, 85–87

See application file for complete search history.

(56) References Cited

U.S. PATENT DOCUMENTS

2005/0190224 A1* 9/2005 Yokoyama ..... 347/17

FOREIGN PATENT DOCUMENTS

JP 2002-86756 A 3/2002
JP 2004-188630 A 7/2004

* cited by examiner

*Primary Examiner*—Matthew Luu
*Assistant Examiner*—Justin Seo
(74) *Attorney, Agent, or Firm*—Birch, Stewart, Kolasch & Birch, LLP

(57) ABSTRACT

An ink cartridge is provided with an ink run-out checking section having an air-curable curing agent. When the ink contained in the ink cartridge is reduced to expose the checking section to air, the curing agent is cured. A movable pushing member pushes a deformable film of the checking section. If the curing agent is uncured, the movable pushing member stops at a position where the deformable film is deformed into the curing agent. If the curing agent is cured, the deformable film cannot deform, so the movable pushing member stops at a position just in contact with the deformable film. Based on the position of the movable pushing member, a controller judges whether the ink remains or not, as well as whether the ink cartridge is mounted or not.

14 Claims, 7 Drawing Sheets

INK RUN-OUT DETECTOR, INK CARTRIDGE AND INK JET RECORDING APPARATUS

FIELD OF THE INVENTION

The present invention relates to an ink cartridge formed with an ink chamber containing ink, an ink jet recording apparatus the ink cartridge is removably attached to, and an ink run-out detector for use in the ink jet recording apparatus.

BACKGROUND OF THE INVENTION

An ink jet recording apparatus has been known, which has a recording head for discharging ink as droplets onto recording paper to print an image. The ink jet recording apparatus is provided with at least an ink container containing ink, to supply the ink to the recording head. The recording head is provided with nozzles and oscillation blades. The oscillation blades are driven individually by piezoelectric elements to change pressure inside the associated nozzles, so that the ink is sucked into and discharged from some of the nozzles when the associated ones of the oscillation blades are driven.

Because the ink is a consumable material, the ink container is often formed as a cartridge that is removably attached to the ink jet recording apparatus, so as to make it easy to supplement the ink jet recording apparatus with the ink. In order to notify the user of necessity to replace the cartridge type ink container, hereinafter called the ink cartridge, the ink jet recording apparatus using the ink cartridge is often provided with an ink run-out detector for checking if the ink in the ink cartridge is used up.

For example, Japanese Laid-open Patent Application No. 2002-86756 discloses an ink jet recording apparatus, wherein an ink holding member, which swells as it absorbs the ink, is affixed to inside an ink cartridge, and an optical sensor detects shrinkage of the ink holding member with reduction of the ink, so as to detect the ink run-out. According to an ink jet recording apparatus disclosed in Japanese Laid-open Patent Application No. 2004-188630, a detection paper strip is attached to an ink cartridge, such that the detection paper strip is colored with ink by an area proportional to the consumed amount of the ink. When an optical sensor detects that the colored area extends to a predetermined position, it is determined that the ink is used up.

However, according to the detection method disclosed in the first prior art, it is difficult to detect the ink run-out with accuracy, because the degree of shrinkage of the ink holding member varies depending upon wavy movement of the ink in the ink cartridge and environmental conditions like humidity. Also the detection method of the second prior art does not ensure accurate detection of the ink run-out, because the extension of the colored area is not always proportional to the consumed amount of the ink, but affected by blotting of the ink on the detection paper strip. Furthermore, both of these prior arts use the optical sensor for detecting the ink run-out based on the intensity of light received on a light receptive portion of the optical sensor. Therefore, when the ink cartridge is not attached to the ink jet recording apparatus, the optical sensor will confuse the absence of the ink cartridge with the ink run-out.

SUMMARY OF THE INVENTION

In view of the foregoing, a primary object of the present invention is to provide such an ink run-out detector for use in an ink jet recording apparatus, that can judge with accuracy whether an ink cartridge runs out of the ink or not, as well as whether the ink cartridge itself is mounted in the ink jet recording apparatus or not, wherein the ink jet recording apparatus is provided with a cartridge mounting section for mounting the ink cartridge in a removable fashion, and ink is supplied to a recording head from the ink cartridge and is discharged from the recording head to record an image on a recording medium.

Another object of the present invention is to provide an ink jet recording apparatus and an ink cartridge having the ink run-out detector of the present invention.

An ink run-out detector according to the present invention comprises a checking section formed in an ink chamber of the ink cartridge, the checking section comprising a curing agent that is cured when the ink contained in the ink chamber is reduced to expose the curing agent to air or light, and an ink-impermeable protection film for protecting the curing agent against the ink as contained in the ink chamber; a detection device for detecting whether the curing agent is uncured or cured while the ink cartridge is mounted on the cartridge mounting section; and a judging device for judging whether the ink remains in the ink chamber or not by a detection result of the detection device.

According to a preferred embodiment, the checking section further comprises a deformable film that is exposed through an opening of a bottom wall of the ink chamber, and is deformable by an external pressure into the checking section so long as the curing agent is uncured, and wherein the detection device comprises a pushing mechanism for pushing the deformable film from outside the ink cartridge as mounted on the cartridge mounting section, and detects whether the deformable film is deformed by the pushing mechanism or not.

The pushing mechanism preferably comprises a movable pushing member for pushing the deformable film from outside, an urging member for urging the pushing member in a direction to push the movable pushing member toward the deformable film, wherein the detection device detects position of the movable pushing member, and the judging device judges that the ink remains in the ink chamber when the detection device detects that the curing agent is uncured as the movable pushing member stops at a first position where the deformable film is deformed, whereas the judging device judges that the ink does not remain in the ink chamber when the detection device detects that the movable pushing member cannot deform the deformable film but stops at a second position before the first position in the pushing direction.

If the ink cartridge is not mounted on the cartridge mounting section, the movable pushing member moves past the first position in the pushing direction and is stopped at a fourth position by the guide member. Therefore, the judging device detects the absence of the ink cartridge when the detection device detects that the movable pushing member moves past the first position.

Preferably, the detection device comprises an optical sensor for detecting the position of the movable pushing member.

According to another preferred embodiment, the detection device comprises a pressure sensor built in the ink cartridge for detecting a change in pressure inside the checking section when the deformable film is deformed into the checking section, so the detecting device detects that the curing agent is cured if the pressure sensor does not detects any change in the pressure even when the pushing mechanism pushes the deformable film.

In this embodiment, the judging device can judge that the ink cartridge is not mounted on the cartridge mounting section when no signal from the pressure sensor is obtained.

According to the present invention, an ink cartridge comprises an ink chamber containing the ink; and a checking section formed in the ink chamber, the checking section comprising a curing agent that is cured when the ink contained in the ink chamber is reduced to expose the curing agent to air or light, a deformable film exposed through an opening of a bottom wall of the ink chamber and deformable by an external pressure so long as the curing agent is uncured, and an ink-impermeable protection film for protecting the curing agent against the ink as contained in the ink chamber, wherein the deformable film is pushed by a pushing mechanism of the ink jet recording apparatus to check if the ink remains in the ink chamber.

The present invention also provides an ink jet recording apparatus for use with the above inventive ink cartridge. The ink jet recording apparatus comprises a detection device for detecting whether the curing agent of the checking section of the ink cartridge as mounted on the cartridge mounting section is uncured or cured; and a judging device for judging whether the ink remains in the ink chamber or not by a detection result of the detection device. The detection device comprises a pushing mechanism for pushing the deformable film from outside the ink cartridge, to detect whether the deformable film is deformed by the pushing mechanism or not. If the deformable film is not deformed, the detection device detects that the curing agent is cured, so the judging device judges that the ink does not remain in the ink chamber.

Because the curing agent of the checking section is kept uncured so long as the ink remains in the ink chamber, and is cured when the ink is reduced to expose the curing agent to air or light, it is possible to judge with accuracy whether the ink remains in the ink chamber or not just by detecting whether the curing agent is uncured or cured. Providing the checking section with the deformable film makes it easy to check if the curing agent is cured or not by applying an external pressure to the deformable film, because the deformable film cannot be deformed after the curing agent is cured. If the ink cartridge is not mounted, the detection device cannot detect the condition of the curing agent, so the judging device can discriminate between the absence of the ink cartridge and the ink run-out.

BRIEF DESCRIPTION OF THE DRAWINGS

The above and other objects and advantages will be more apparent from the following detailed description of the preferred embodiments when read in connection with the accompanied drawings, wherein like reference numerals designate like or corresponding parts throughout the several views, and wherein.

DESCRIPTION OF THE PREFERRED EMBODIMENTS

Figure 1:
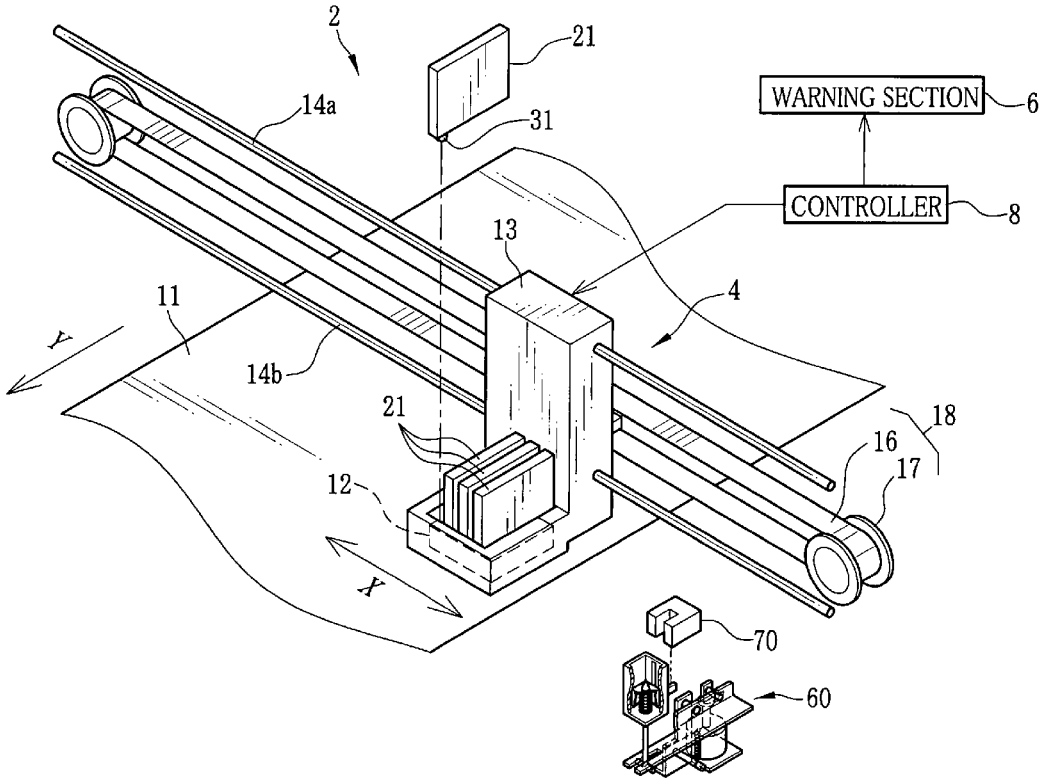
FIG. 1 is an explanatory diagram illustrating essential elements of an ink jet recording apparatus according to an embodiment of the invention.

An ink jet recording apparatus 2 shown in FIG. 1 consists of a recording section 4, a warning section 6 and a controller 8 for supervising respective components of the recording apparatus 2. The recording section 4 is provided with a recording head 12 for discharging ink toward a recording medium, e.g. a paper sheet 11, to print images thereon. The warning section 6 is for warning the user of any malfunction of the recording section 4 during the printing.

The recording head 12 is provided with a plurality of not-shown nozzles for discharging the ink from individual outlets. The outlets of the nozzles are arranged in a plane to form a discharging surface, and the discharging surface is placed in face to a recording surface of the paper sheet 11. The recording head 12 is mounted in a carriage 13 that is movable in a widthwise direction of the paper sheet 11, that is, a main scanning direction X as shown in FIG. 1. The discharging surface is exposed through an opening formed through a bottom of the carriage 13. While reciprocating in the widthwise direction of the paper sheet 11 together with the carriage 13, the recording head 12 records an image serially line by line. Each time the recording head 12 makes one lap to record a line of the image, the paper sheet 11 is fed by not-shown conveyer rollers in a sub scanning direction Y, that is orthogonal to the main scanning direction X, by a length corresponding to a width of each image line as recorded by the recording head 12. Thus, a frame of image is recorded on the paper sheet 11.

The carriage 13 is mounted on a pair of guide rods 14*a* and 14*b* to slide thereon, and is driven by a belt mechanism 18 that consists of a belt 16 and a pair of pulleys 17. The carriage 13 carries a number of ink cartridges 21, e.g. four cartridges containing inks of four different colors: yellow, magenta, cyan and black.

The carriage 13 is provided with not-shown slots for mounting the respective ink cartridges 21. In each slot, there is provided an ink supply needle 36, see FIG. 2, having a through-hole as a path for supplying the ink to the recording head 12. As the ink cartridge 21 is plugged in the slot, the ink supply needle 36 sticks into an ink outlet 31 that is formed on a bottom of the ink cartridge 21. So the ink contained in the ink cartridge 21 is supplied through an ink supply path from the ink outlet 31 through the ink supply needle 36 to the recording head 12. Oscillation blades are provided in the recording head 12 in correspondence with the respective nozzles. The oscillation blades are driven individually by piezoelectric elements, to change pressure inside the allocated ink supply path. Thereby, the ink in the ink cartridge 21 is sucked into the nozzle, and is ejected from the outlet of the nozzle.

Figure 2:
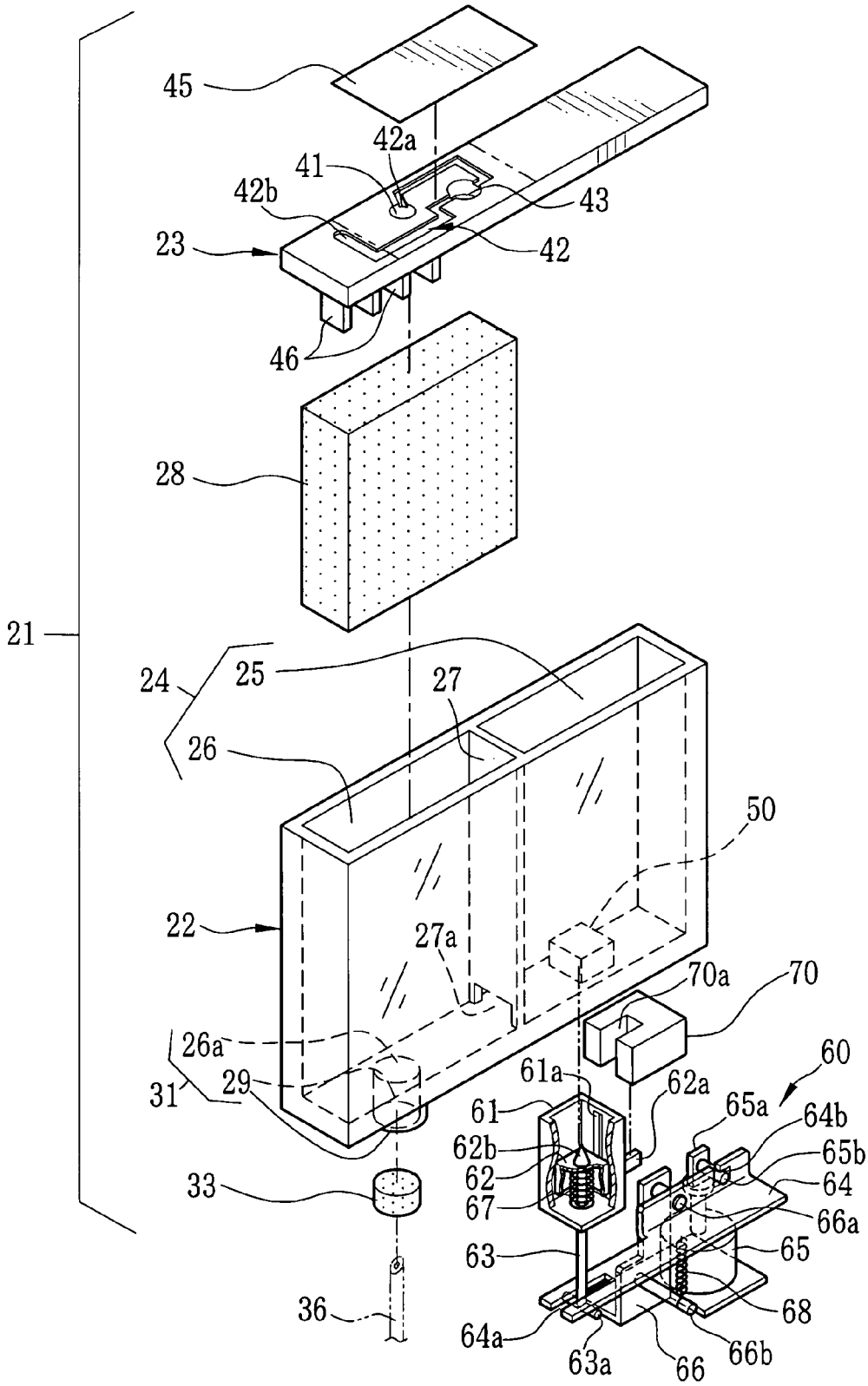
FIG. 2 is an exploded perspective view of an ink cartridge used in the ink jet recording apparatus of FIG. 1.

As shown in FIG. 2, the ink cartridge 21 consists of a case body 22 formed with ink chambers 24 for storing the ink, and a lid 23 for closing an open top of the case body 22. The lid 23 is affixed to the case body 22, for example, by welding, after the case body 22 is filled with the ink. Thereby, the ink is prevented from leaking through the open top of the case body 22. The case body 22 is formed from a transparent plastic or the like, so the remaining amount of the ink in the ink cartridge 21 is visible from outside.

The ink chamber 24 is sectioned by a partition wall 27 into an ink absorbent chamber 26 holding an ink absorbent 28 and a storage chamber 25 for storing the ink. The ink absorbent 28 absorbs and holds the ink by its capillary force. The ink absorbent chamber 26 and the storage chamber 25 are interconnected through an interconnection slot 27*a* formed through the partition wall 27 in a portion near the bottom of the ink chamber 24. Thus, the ink absorbent 28 absorbs the ink from the storage chamber 25 through the interconnection slot 27*a*.

An ejection opening 26*a* for ejecting the ink from the ink absorbent chamber 26 out of the case body 22 is formed through a bottom portion of the ink absorbent chamber 26. The ejection opening 26*a* and an ejection tube 29 extending downward from the ejection opening 26*a* constitute an ink outlet 31. A filter 33 for filtering the ink is set in the ejection tube 29.

The ink absorbent 28 is a spongy material having micro holes that generate the capillary force. Concretely, the ink absorbent 28 is made of a porous material, including a foamed material like urethane foam, or a fibrous material like felt. The filter 33 is a spongy member that generates a capillary force like the ink absorbent 28. A top surface of the filter 33 is in tight contact with a bottom surface of the ink absorbent 28, so that the filter 33 absorbs the ink from the ink absorbent 28 by its capillary force. As the ink cartridge 21 is attached to the carriage 13, the ink absorbent chamber 26 is connected to the recording head 12 that is placed under the carriage 13. More specifically, as the ink cartridge 21 is attached to the carriage 13, the ink supply needle 36 in the slot of the carriage 13 is stuck from the bottom into the filter 33, providing the ink supply path from the ink cartridge 21 through the ink supply needle 36 to the associated nozzle of the recording head 12.

The ink absorbent 28 generates a negative pressure due to its capillarity, which keeps pressure inside the ink absorbent chamber 26 negative to the atmosphere. Keeping the pressure in the ink absorbent chamber 26 negative to the atmosphere makes pressure inside the nozzles of the recording head 12 negative to the atmosphere. As a result, an interface of the ink to the atmosphere at the outlet of each nozzle gets meniscus, i.e. concave into the nozzle, so the ink may not leak from the nozzle.

For printing, the recording head 12 generates such a suction force against the negative pressure inside the ink absorbent chamber 26, that the ink is sucked from the ink absorbent chamber 26 and discharged from the outlet of the nozzles. As the ink is supplied to the recording head 12, the pressure in the ink absorbent chamber 26 decreases, so air enters the ink absorbent chamber 26 through an air entrance 41 that is formed through the lid 23. The ink contained in the ink chamber 24 is consumed first from the portion in the ink absorbent chamber 26, and the ink is supplied from the storage chamber 25 to the ink absorbent chamber 26 for refill. As the internal pressure of the storage chamber 25 decreases with the ink, air is taken into the storage chamber 25 through the interconnection slot 27*a*. Repeating the gas-liquid exchange as above, the ink is fed to the recording head 12.

The lid 23 has a meander groove 42 formed on its top side. One end 42*a* of the groove 42 is connected to the air entrance 41, and a liquid sink 43 is formed on a path from the end 42*a* to a second end 42*b* . A section of the groove 42 exclusive of the second end 42*a* , i.e. the section between phantom lines in FIG. 2, is covered from the top with a seal 45, so the second end 42*b* alone is exposed to the atmosphere. The groove 42 leads the ink to the liquid sink 43 if the ink leaks through the air entrance 41 out of the ink absorbent chamber 26. So the ink is prevented from spilling out of the ink cartridge 21. The air is introduced from the second end 42*b* into the air entrance 41.

A plurality of ribs 46 are formed on the bottom side of the lid 23 in an area facing to the ink absorbent chamber 26. As the lid 23 is attached to the case body 22, the ribs 46 protrude into the ink absorbent chamber 26 and come into contact with a top side of the ink absorbent 28, pressing down the ink absorbent 28 onto the bottom of the ink absorbent chamber 26. Thereby, the ink absorbent 28 is fixedly positioned to provide a room between the ink absorbent 28 and the lid 23, preventing the ink absorbent 28 from being displaced to close the air entrance 41.

Figure 3A:
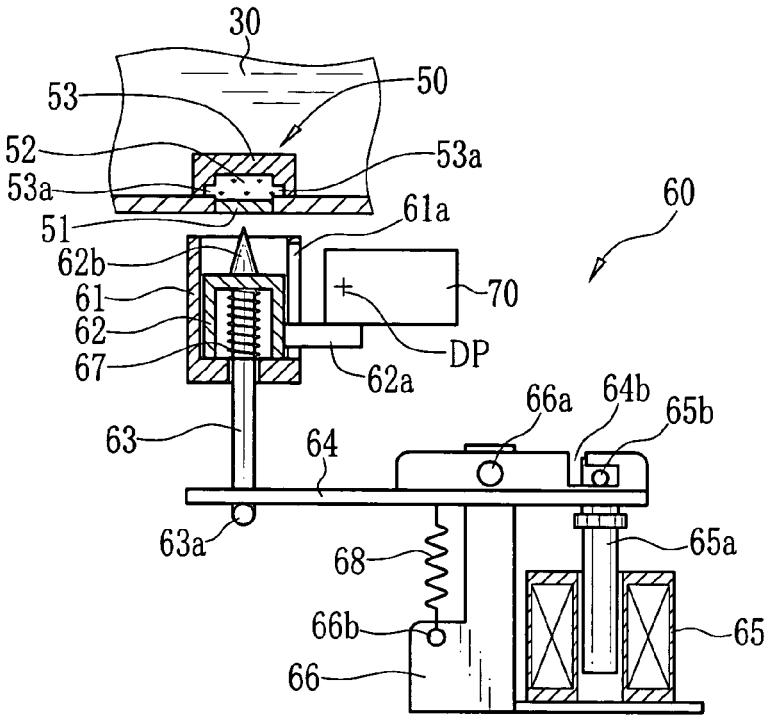
FIGS. 3A, 3B and 3C are explanatory views illustrating how a pushing mechanism cooperates with an ink run-out checking section of the ink cartridge.

The ink cartridge 21 is further provided with an ink run-out checking section 50 that is used for the ink jet recording apparatus 2 to check if the ink chamber 24 runs out of the ink. As shown in FIG. 3A, the ink run-out checking section 50 consists of a deformable film 51, a curing agent 52 and a protection film 53. The deformable film 51 closes an opening formed through a bottom wall of the ink chamber 24, and resiliently deforms as being pushed. The curing agent 52 is sandwiched between the deformable film 51 and the protection film 53. The protection film 53 prevents permeation of the ink 30 through it, but permits permeation of air. On the other hand, the deformable film 51 is airtight. The curing agent 52 is initially soft and gets hard when it is exposed to air. As the ink 30 in the ink chamber 24 is reduced to expose the protection film 53 to air, air comes into contact with the curing agent 52, and hardens the curing agent 52. Then, a pressure applied from outside the ink chamber 24 cannot deform the deformable film 51.

For example, cement and aerobic adhesives, which are hardened as they come into contact with air, are usable as the curing agent 52. The protection film 53 is made of a vapor permeable waterproof sheet, such as Gore-Tex (a trade name), which prevents permeation of the ink 30, but permits permeation of air. So long as the ink 30 remains in the ink chamber 24, the curing agent 52 is kept uncured. When the ink 30 in the ink chamber 24 is used up, the curing agent 52 reacts with air inside the storage chamber 25, and gets hard. The protection film 53 has a recess 53*a* in its inside surface, so a portion of the curing agent 52 enters the recess 53*a* . Because the curing agent 52 gets hard in this condition, the recess 53*a* catches the hardened curing agent 52 to stop it from moving up and down inside the protection film 53.

Referring back to FIG. 1, there is a home position on one terminal of a moving range of the carriage 13, where the recording head 12 does not face the paper sheet 11. Instead, a pushing mechanism 60 and a photo-interrupter 70 are disposed below the home position. While the carriage 13 stops at the home position, the pushing mechanism 60 pushes the deformable film 51 of the ink cartridge 21 as mounted on the carriage 13, to check if the ink 30 remains in the ink chamber 24. The photo-interrupter 70 detects whether the deformable film 51 is deformed or not as it is pushed by the pushing mechanism 60. The pushing mechanism 60 and the photo-interrupter 70 are used for checking the ink run-out of the respective ink cartridges 21. To check the ink run-out of one of the ink cartridges 21, the position of the carriage 13 is adjusted to oppose to the deformable film 51 of the one ink cartridge 21. However, it is possible to provide a corresponding number of pushing mechanisms 60 and photo-interrupters 70 to the respective ink cartridges 21 on the carriage 13.

As shown in FIG. 2, the pushing mechanism 60 is constituted of a box-shaped guide frame 61 that is immovably built in the ink jet recording apparatus 2, a movable pushing member 62 that is movable up and down inside the guide frame 61, a lock member 64 that controls the movement of the movable pushing member 62 through an arm 63, a solenoid 65 and a holding frame 66.

A coil spring 67 is mounted between the movable pushing member 62 and the guide frame 61, to urge the movable pushing member 62 upward. A vertical slot 61*a* is formed through one side of the guide frame 61, and a blade 62*a* provided on the movable pushing member 62 is engaged in the slot 61*a* . As the movable pushing member 62 is urged upward by the coil spring 67, the movable pushing member 62 protrudes from the guide frame 61 through an open top of the guide frame 61, but the blade 62*a* is stopped at an upper end of the slot 61*a* , so the movable pushing member 62 does not further protrude and get out of the guide frame 61. An upper end of the arm 63 is inserted into the guide frame 61 through its bottom opening, and is coupled to the movable pushing member 62. A T-shaped engaging portion 63*a* is formed on a lower end of the arm 63.

The holding frame 66 holds the lock member 64 such that the lock member 64 can swing about a pivotal axis 66*a* . The lock member 64 has a channel-shaped slit 64*a* in one end, and the arm 63 is put through the slit 64*a*. The lock member 64 has a cutout 64*b* in other end, as shown in FIG. 3, and a pin 65*b* is engaged in the cutout 64*b*. The pin 65*b* is coupled to a movable iron core 65*b* of the solenoid 65. The cutout 64 is made so larger than the pin 65*b* as to permit the lock member 64 to swing.

A coil spring 68 is mounted to a rear side of the lock member 64. Another end of the coil spring 68 is hooked on a pin 66*b* that is formed on the holding frame 66, to pull the lock member 64 toward the holding frame 66. The force of the coil spring 68 is set stronger than the force of the coil spring 67 that urges the movable pushing member 62 upward. Therefore, unless the solenoid 65 is excited, the lock member 64 swings in a counterclockwise direction in FIG. 3, according to the force of the coil spring 68. Then, the slit 64*a* comes into engagement with the engaging portion 63*a* of the arm 63, and pull the movable pushing member 62 downward against the force of the coil spring 67. In result, the movable pushing member 62 is brought into contact with an inner bottom surface of the guide frame 61, as shown in FIG. 3A, and is held in this position, which will be recited as a third position in the claims. On the other hand, because of the engagement between the cutout 64*b* and the pin 65*b* , the movable iron core 65*a* is pulled out from a main body of the solenoid 65, in the position shown in FIG. 3A.

Figure 3B:
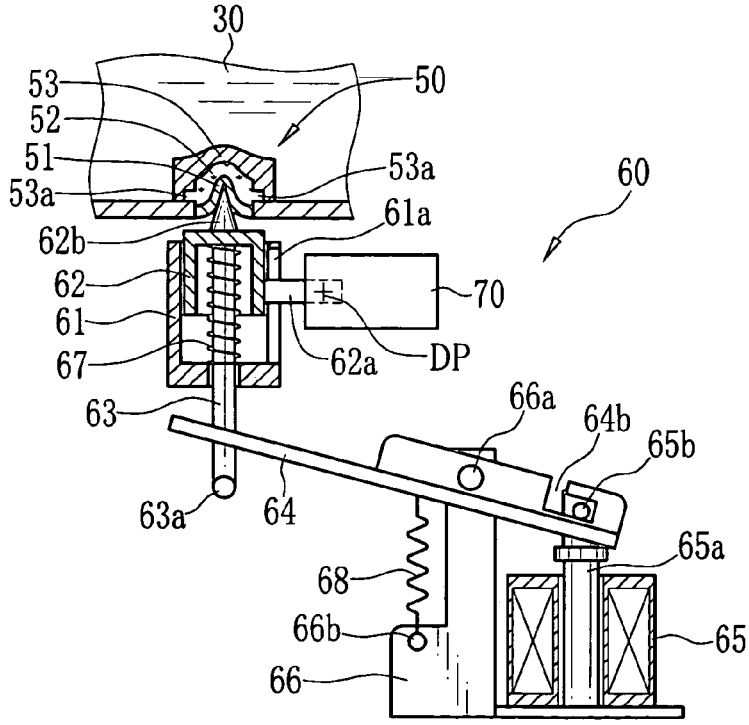

When the solenoid 65 is excited, the movable iron core 65*a* is pulled into the main body of the solenoid 65. That is, the solenoid 65 is so called pull-type. As the movable iron core 65*a* is pulled into the solenoid 65, the lock member 64 swings in a clockwise direction in FIG. 3, against the force of the coil spring 68. In result, as shown in FIG. 4, the engaging portion 63*a* is disengaged from the slit 64*a* , so the movable pushing member 62 moves upward according to the force of the coil spring 67. When the solenoid 65 is degaussed, the force of the coil spring 68 causes the lock member 64 to swing again in the counterclockwise direction, returning to the position shown in FIG. 3A. The solenoid 65 is electrically connected to the controller 8, so the controller 8 controls excitation and demagnetization of the solenoid 65.

The photo-interrupter 70 is of a transmission type that has a light emitting element and a light receiving element, which are not shown but placed across a channel 70*a* from each other. The photo-interrupter 70 detects any object passing through the channel 70*a* because the object interrupts sensor-light from the light emitting element. The photo-interrupter 70 is placed in the ink jet recording apparatus 2, such that the blade 62*a* of the movable pushing member 62 comes into the channel 70*a* as the movable pushing member 62 moves upward. The photo-interrupter 70 is electrically connected to the controller 8, so a detection signal from the photo-interrupter 70 is fed to the controller 8.

When the movable pushing member 62 is moved upward by exciting the solenoid 65, a projection 62*b* formed at the upper end of the movable pushing member 62 pushes the deformable film 51 from the bottom. If the curing agent 52 is uncured at that time, the deformable film 51 is deformed as shown in FIG. 3B, and the movable pushing member 62 stops at a position where the pushing projection 62*b* thrusts into the ink run-out checking section 50, which will be recited as a first position in the claims. In this position, the blade 62*a* of the movable pushing member 62 comes to a detecting position DP of the photo-interrupter 70, interrupting the sensor-light from the light-emitting element. Accordingly, if the photo-interrupter 70 detects that the blade 62*a* reaches the detecting position DP while the solenoid 65 is being excited, the controller 8 judges that the curing agent 52 is uncured and the ink 30 remains in the ink chamber 24.

Figure 3C:
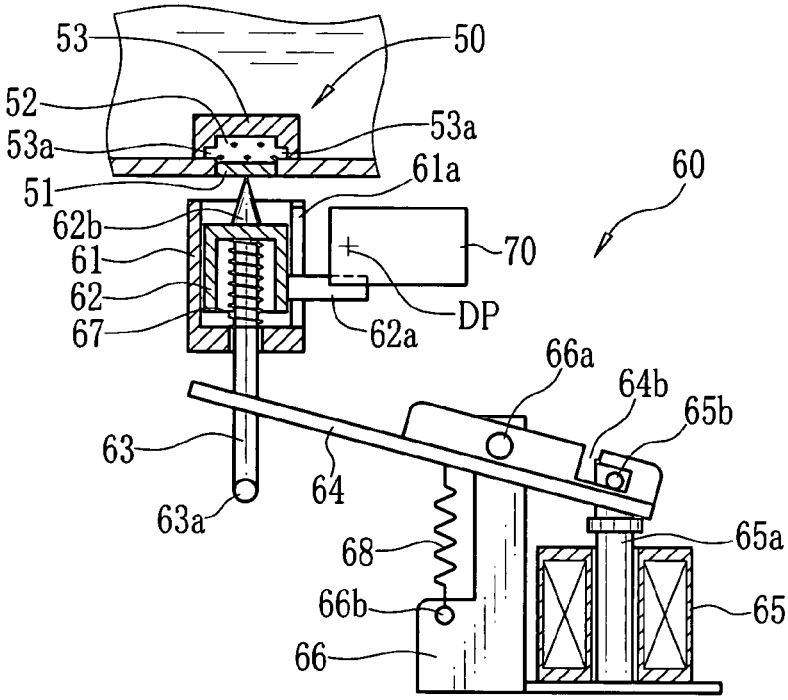
Figure 4:
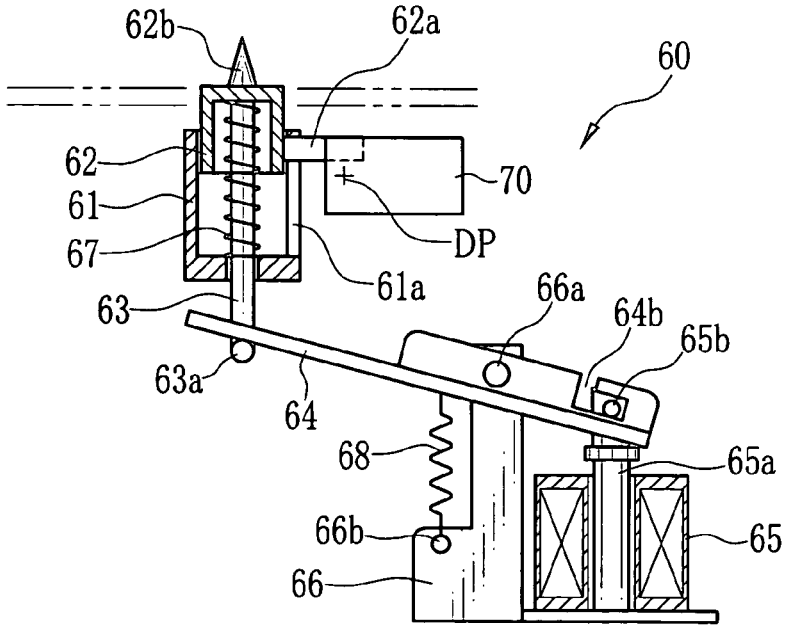
FIG. 4 is an explanatory view illustrating how the pushing mechanism detects absence of the ink cartridge.

On the contrary, if the curing agent 52 is cured since the ink 30 in the ink chamber 24 is used up, the cured curing agent 52 hinders deformation of the deformable film 51, so the pushing projection 62*b* cannot thrust into the ink run-out checking section 50, but stops at a position as shown in FIG. 3C, where the pushing projection 62*b* is just in contact with the deformable film 51, which will be recited as a second position in the claims. In this position, the blade 62*a* of the movable pushing member 62 does not reach the detecting position DP. Accordingly, if the photo-interrupter 70 does not detect the blade 62*a* even while the solenoid 65 is excited, the controller 8 judges that the curing agent 52 is cured and the ink 30 is used up.

On the other hand, if the solenoid 65 is excited while the ink cartridge 21 is not mounted in one of the slots of the carriage 13, which is opposed to the pushing mechanism 60, the movable pushing member 62 does not strike against the deformable film 51, but the movable pushing member 62 reaches a position where the blade 62*a* strikes against the upper end of the slot 61*a* of the guide frame 61, as shown in FIG. 4. This position will be recited as a fourth position in the claims. On the way to the fourth position, the blade 62*a* goes past the detecting position DP, so the sensor-light is interrupted for a moment. As the photo-interrupter 70 outputs a corresponding detection signal to the controller 8, the controller 8 can detect that there is not any ink cartridge 21 in the corresponding slot of the carriage 13.

The warning section 6 is connected to the controller 8, so the controller 8 drives the warning section 6 to warn the user of the ink run-out or the absence of the ink cartridge 21. The warning section 6 may be constituted of a display device, such as an LCD panel, or an optical signal generator, such as a lamp or an LED array, or an alarming device, such as a speaker.

Now the operation of the ink jet recording apparatus 2 of the present embodiment will be described.

The controller 8 performs checking if the ink cartridge 21 as opposed to the pushing mechanism 60 contains the ink 30, or if the ink cartridge 21 is mounted in the corresponding slot of the carriage 13, by exciting the solenoid 65 of the pushing mechanism 60 at predetermined times, e.g. immediately after the ink jet recording apparatus 2 is powered on, and before the recording head 12 starts recording an image.

While exciting the solenoid 65, the controller 8 monitors the output signal from the photo-interrupter 70. If the photo-interrupter 70 detects that the blade 62*a* stops at the detecting position DP, as shown in FIG. 3B, the controller 8 judges that the ink 30 remains in the ink chamber 24 of the checked ink cartridge 21. If the photo-interrupter 70 does not detect the blade 62*a* , as shown in FIG. 3C, the controller 8 judges that the ink 30 does not remain in the ink chamber 24. While adjusting the position of the carriage 13, the controller 8 performs the same checking on the individual ink cartridges 21 as mounted on the carriage 13.

If any of the ink cartridges 21 is judged to be used up, the controller 8 drives the warning section 6 to warn the user of the ink run-out. The warning section 6 may give a simple warning of the ink run-out, or a detailed warning that notifies which of the ink cartridges 21 runs out of the ink. Instead of warning the ink run-out as soon as the controller 8 judges it by the detection signal from the photo-interrupter 70, it is possible to warn the ink run-out with certain time duration from the detection of the ink run-out by the photo-interrupter 70. For example, even after the ink run-out is detected based on the detection signal from the photo-interrupter 70, the controller 8 still drives the recording head 12 to discharge the ink till the ink absorbed in the ink absorbent 28, the absorbed amount of the ink being previously measured, is used up. Thereafter, the controller 8 drives the warning section 6 to warn about the ink run-out. That is, the controller 8 may detect based on the detection signal from the photo-interrupter 70 that the ink in the ink chamber 24 gets less than a predetermined amount.

If the photo-interrupter 70 detects a temporary interruption of the sensor light by the blade 62*a* while the solenoid 65 is being excited, the controller 8 judges that the ink cartridge 21 is not mounted in the corresponding slot of the carriage 13. If any of the ink cartridges 21 is not mounted on the carriage 13, the controller 8 drives the warning section 6 to warn the user of that fact.

Although the pushing mechanism 60 is provided with the lock member 64 and the solenoid 65 so as to move the movable pushing member 62 between a position pushing the ink run-out checking section 50 and a position away from the ink run-out checking section 50, it is alternatively possible to constitute a pushing mechanism of the guide frame 61, the movable pushing member 62 and the coil spring 67 without the lock member 64 and the solenoid 65, so that the movable pushing member 62 always pushes the deformable film 51 of the ink cartridge 21 as it is mounted on the carriage 13.

As a device for detecting the position of the movable pushing member 62, not only the transmission type photo-interrupter 70, but also a reflective photo sensor or another optical sensor, a magnetic sensor or a mechanical switch is usable. Although the pushing mechanism 60 and the photo-interrupter 70 are disposed in the home position of the carriage 13, it is possible to mount a number of pushing mechanisms and photo-interrupters on a carriage 13 in correspondence with the respective ink cartridges 21.

Figure 5:
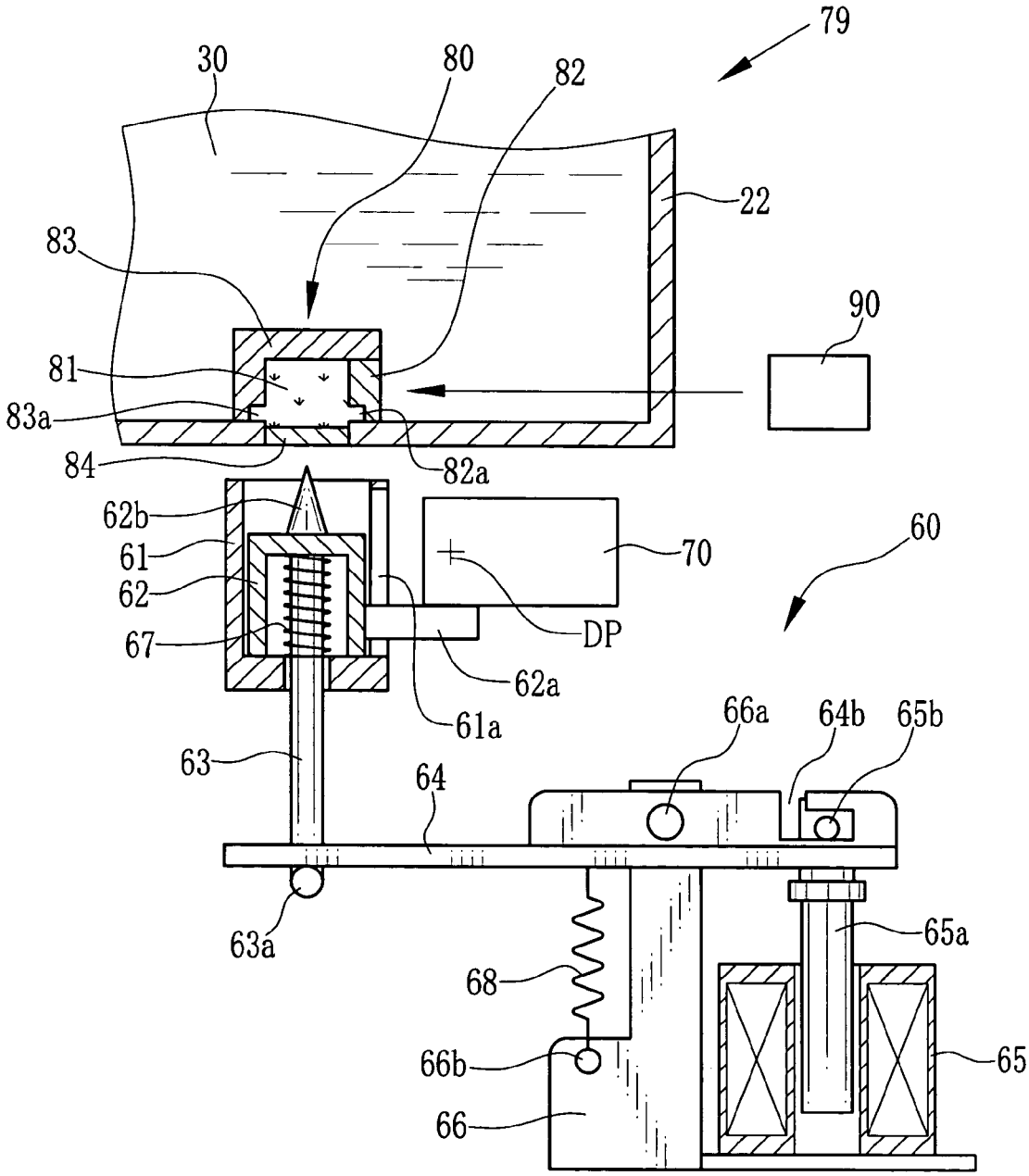
FIG. 5 is a fragmentary sectional view illustrating an ink cartridge according to another embodiment of the invention.

FIG. 5 shows another embodiment of the present invention, wherein like or equivalent components are designated by the same reference numerals, so the detailed description of these components is omitted for brevity sake. An ink run-out checking section 80 of an ink cartridge 79 of the present embodiment is provided with a curing agent 81 that starts curing when exposed to a ray of a specific wavelength. For example, the curing agent 81 is a light-curable resin. One side of the curing agent 81 is covered with a first protection film 82 that is light-permeable, whereas other sides and top of the curing agent 81 are covered with a second protection film 83 that blocks light. Bottom of the curing agent 81 is covered with a deformable film 84. The protection films 82 and 83 are waterproof, so the ink 30 cannot permeate through them. Like the first embodiment, the protection films 82 and 83 have respective recesses 82*a* and 83*a* for fixing the position of the curing agent 81 after being cured. A case body 22 of the ink cartridge 79 is transparent or translucent.

An ink jet recording apparatus of the present embodiment is provided with a light source 90 that emits the ray of the specific wavelength for curing the curing agent 81. In a case where the curing agent 81 is a light-curable resin, an ultraviolet laser or an ultraviolet lamp is used as the light source 90. The light source 90 is positioned to project the ray toward the first protection film 82.

So long as the ink 30 remains in an ink chamber 24, the ray from the light source 90 is blocked by the ink 30 and does not reach the curing agent 81, so the curing agent 81 is kept uncured. To ensure the blocking effect of the ink 30, it is preferable to dispose the light source 90 to each of the ink cartridges of the different colors, and determine the respective wavelengths of the light sources 90 while taking account of light absorption of the respective color inks.

When the ink 30 is used up, the ray from the light source 90 reaches the curing agent 81 through the transparent case body 22 and first protection film 82, so the curing agent 81 gets hard. As the deformable film 84 is pushed by a pushing mechanism 60, and the position of a blade 62*a* is detected by a photo-interrupter 70, the present embodiment using the light-curable curing agent 81 and the light source 90 provides the same effect as the first embodiment using the air-curable curing agent 51. Instead of the light source 90, it is possible to guide natural light into the ink run-out checking section 80.

Figure 6A:
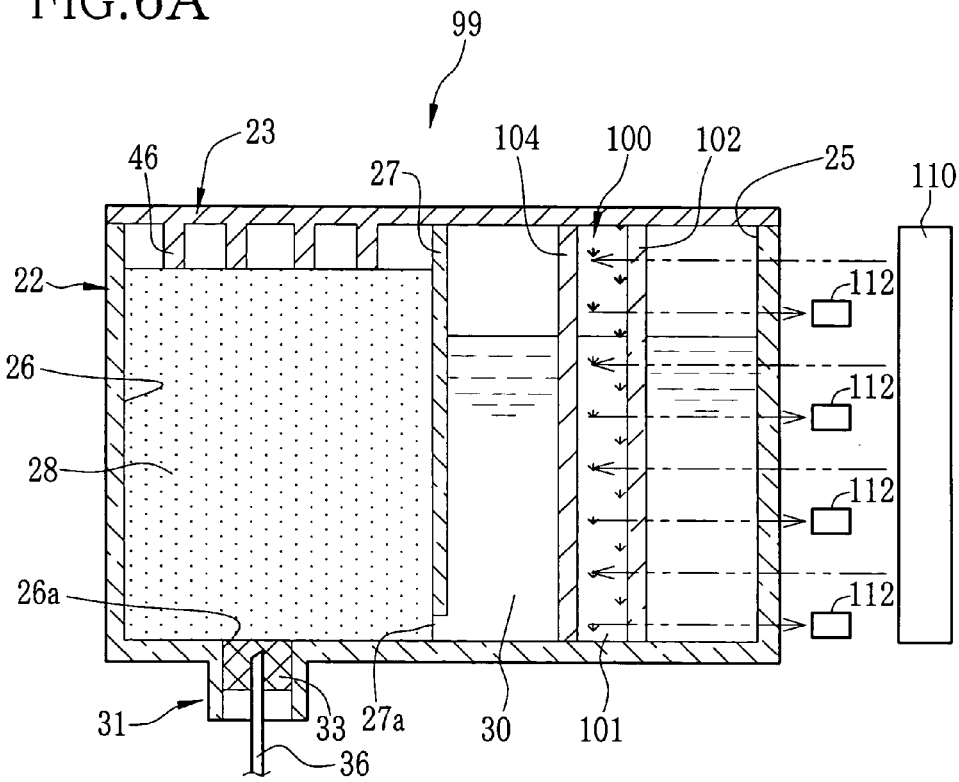
FIGS. 6A and 6B are vertical and horizontal sectional views, illustrating an ink cartridge and a light source served for checking level of ink contained in the ink cartridge, according to a further embodiment of the invention.
Figure 6B:
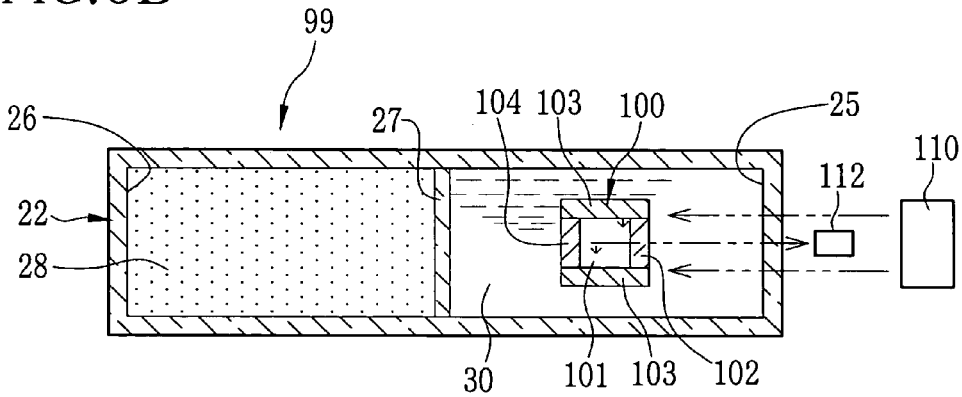

Instead of the pushing mechanism 60 and the photo-interrupter 70, an optical sensor, such as a photo diode, may be disposed beside the light source 90, so as to receive light reflected from the curing agent 81, and judge based on the received light whether the ink remains or not. Alternatively, as shown in FIG. 6, it is also possible to provide an ink cartridge 99 with an ink run-out checking section 100 that extends from top to bottom of a storage chamber 25. In that case, an elongated light source 110 is disposed to illuminate the whole length of the ink run-out checking section 100. A number of photo diodes 112 are apposed in face to the ink run-out checking section 100, so as to receive light reflected from different vertical positions of the ink run-out checking section 100.

The ink run-out checking section 100 is formed as a quadric prism, and consists of a light-curable curing agent 101 and first to third protection films 102, 103 and 104 coving four sides of the curing agent 101. The first protection film 102 is transparent or light-permeable, and covers one side facing to the light source 110, so that if the ink 30 does not exist the light from the light source 110 may enter the curing agent 101 through the first protection film 102. The second protection films 103 cover those sides extending in parallel to the light from the light source 110, and have a light blocking effect to block other light than the light from the light source 110. Accordingly, the curing agent 101 is kept uncured while the storage chamber 25 is filled with the ink 30. As the ink level goes down, the curing agent 101 is hardened gradually from the top. The third protection film 104 covers the backside of the curing agent 101 to the light source 110. At least a surface of the third protection film 104, which is in contact with the curing agent 101, has a high reflection factor, so the light entering the curing agent 101 may be efficiently reflected to any of the photo diodes 112. Based on the levels of light reflected from the curing agent 101 and received on the photo diodes 112, it is possible to detect the gradually decreasing ink level in the ink chamber 24, not just detect the ink run-out.

The light-curable curing agent 101 may be a material whose transparency changes before and after it is cured. In that case, it is possible to determine as to whether the curing agent 101 is hardened or not, based on the level of light transmitted through the curing agent 101.

Figure 7:
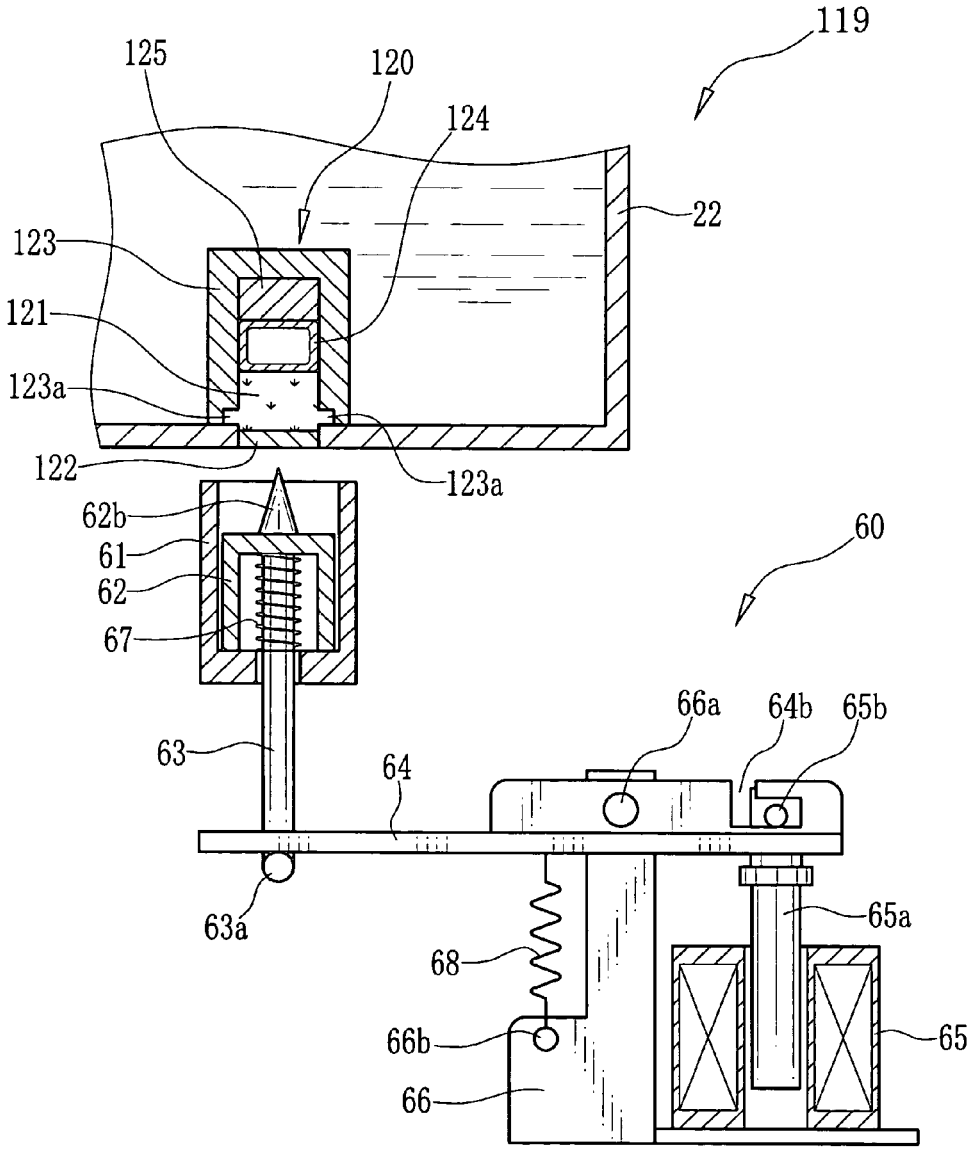
FIG. 7 is a fragmentary sectional view illustrating an ink cartridge according to still another embodiment of the invention.

In the above-described embodiments, the detection device for detecting whether the curing agent is uncured or cured uses the photo-interrupter 70 that is built in the ink jet recording apparatus 2. Instead, the detection device may use a pressure sensor 125 that is built in an ink run-out checking section 120 of an ink cartridge 119, as shown in FIG. 7. The ink run-out checking section 120 has a curing agent 121, a deformable film 122 and a protection film 123 in the same manner as the first embodiment. Besides, the ink run-out checking section 120 has a flexible gas-tight bag 124 and the pressure sensor 124 inside the protection film 123. The bag 124 contains a compressible gas, e.g. air, and sandwiched between the curing agent 121 and the pressure sensor 125. The curing agent 121 may be air-curable or light-curable, and the protection film 123 is made of an appropriate material according to the type of the curing agent 121. The protection film 123 is provided with a recess 123*a* for holding the cured curing agent 121 immovable in the ink run-out checking section 120.

So long as the curing agent 121 is uncured, a projection 62*b* can push up the deformable film 122 and thrust into the ink run-out checking section 120, like as shown in FIG. 3B. Then, the gas inside the bag 124 is compressed, and thus the pressure applied from a pushing mechanism 60 is transmitted to the pressure sensor 125.

Although it is omitted from FIG. 7, the pressure sensor 125 is connected to a controller of an ink jet recording apparatus through contact terminals or connectors when the ink cartridge 119 is mounted on a carriage. The pressure sensor 125 measures the pressure applied from the pushing mechanism 60 through the curing agent 121 and the bag 124 to the pressure sensor 125, and inputs the measured pressure to the controller. In order to measure the pressure exactly, the protection film 123 preferably has such rigidity that it does not deform by the pressure from the pushing mechanism 60. For example, a piezoresistance semiconductor sensor is usable as the pressure sensor 125.

If the pressure sensor 125 detects a change in pressure inside the ink run-out checking section 120 while a solenoid 65 is being excited to push the deformable film 122 by the pushing projection 62*b* , the controller judges that the curing agent 121 is uncured and thus the ink remains in the ink cartridge 119.

If, on the contrary, the ink does not remain and so the curing agent 121 is hardened, the deformable film 122 cannot deform, so the pressure sensor 125 does not detect any pressure change in the ink run-out checking section 120 even when the solenoid 65 is excited. In that case, the controller judges that the ink cartridge 119 has run out of the ink.

When the ink cartridge 119 is not mounted on the carriage, the controller does not receive any output signal from the pressure sensor 125. Thus, the ink cartridge 119 having the detection device incorporated therein also permits detecting not only the ink run-out but also the absence of the ink cartridge 119, like the above embodiments.

Thus the present invention is not to be limited to the above-described embodiments, but various modifications will be possible without departing from the scope of claims as appended hereto.

What is claimed is:

1. An ink run-out detector for use in an ink jet recording apparatus that is provided with a cartridge mounting section for mounting an ink cartridge in a removable fashion, and a recording head in which ink is supplied from said ink cartridge and is discharged to record an image on a recording medium, said ink run-out detector comprising:

a checking section formed in an ink chamber of said ink cartridge, said checking section comprising a curing agent that is cured when the ink contained in said ink chamber is reduced to expose said curing agent to air or light, and an ink-impermeable protection film for protecting said curing agent against the ink as contained in said ink chamber;

a detection device for detecting whether said curing agent is uncured or cured while said ink cartridge is mounted on said cartridge mounting section; and a judging device for judging whether the ink remains in said ink chamber or not by a detection result of said detection device.

2. An ink run-out detector as claimed in claim 1, wherein said checking section further comprises a deformable film that is exposed through an opening of a bottom wall of said ink chamber, and is deformable by an external pressure into said checking section so long as said curing agent is uncured, and wherein said detection device comprises a pushing mechanism for pushing said deformable film from outside said ink cartridge as mounted on said cartridge mounting section, and detects whether said deformable film is deformed by said pushing mechanism or not.

3. An ink run-out detector as claimed in claim 2, wherein said pushing mechanism comprises a movable pushing member for pushing said deformable film from outside, an urging member for urging said pushing member in a direction to push said deformable film, and a guide member for holding and guiding said movable pushing member toward said deformable film, wherein said detection device detects position of said movable pushing member, and said judging device judges that the ink remains in said ink chamber when said detection device detects that said curing agent is uncured as said movable pushing member stops at a first position where said deformable film is deformed, whereas said judging device judges that the ink does not remain in said ink chamber when said detection device detects that said movable pushing member cannot deform said deformable film but stops at a second position before said first position in said pushing direction.

4. An ink run-out detector as claimed in claim 3, wherein said pushing mechanism comprises a lock member for locking said movable pushing member at a third position away from said deformable film against the urging force of said urging member, and said detection device and said judging device are activated when said lock member unlocks said movable pushing member to permit moving from said third position in said pushing direction.

5. An ink run-out detector as claimed in claim 4, wherein if said ink cartridge is not mounted on said cartridge mounting section, said movable pushing member as unlocked moves past said first position in said pushing direction and is stopped at a fourth position by said guide member, and said judging device detects the absence of said ink cartridge when said detection device detects that said movable pushing member moves past said first position.

6. An ink run-out detector as claimed in claim 3, wherein said detection device comprises an optical sensor for detecting the position of said movable pushing member.

7. An ink run-out detector as claimed in claim 2, wherein said detection device comprises a pressure sensor built in said ink cartridge for detecting a change in pressure inside said checking section when said deformable film is deformed into said checking section, so said detecting device detects that said curing agent is cured if said pressure sensor does not detects any change in the pressure even when said pushing mechanism pushes said deformable film.

8. An ink run-out detector as claimed in claim 7, wherein said judging device judges that said ink cartridge is not mounted on said cartridge mounting section when no signal from said pressure sensor is obtained.

9. An ink run-out detector as claimed in claim 1, wherein said protection film allows permeation of air through it, and said curing agent is air-curable.

10. An ink run-out detector as claimed in claim 1, wherein said protection film is at least partly light-permeable, and said curing agent is light-curable.

11. An ink run-out detector as claimed in claim 10, further comprising a light source for emitting light of a predetermined wavelength for curing said curing agent toward said light-permeable part of said protection film as said ink cartridge is mounted on said cartridge mounting section.

12. An ink run-out detector as claimed in claim 10, wherein said checking section further comprises a deformable film that is exposed through an opening of a bottom wall of said ink chamber, and is deformable by an external pressure into said checking section so long as said curing agent is uncured, and wherein said detection device comprises a pushing mechanism for pushing said deformable film from outside said ink cartridge as mounted on said cartridge mounting section, and detects whether said deformable film is deformed by said pushing mechanism or not.

13. An ink run-out detector as claimed in claim 11, wherein said detection device comprises at least a light receiving element for receiving light from said checking section while said light source is emitting the light, to detect based on the light received on said light receiving element whether said curing agent is uncured or cured.

14. An ink run-out detector as claimed in claim 1, further comprising a warning device for warning that the ink does not remain in said ink chamber when it is judged by said judging device.

* * * * *